US011401788B2

(12) United States Patent
Shaw

(10) Patent No.: US 11,401,788 B2
(45) Date of Patent: Aug. 2, 2022

(54) SYSTEM AND METHOD OF WELL OPERATIONS USING A VIRTUAL PLUNGER

(71) Applicant: Silverwell Technology Ltd, Histon (GB)

(72) Inventor: Joel David Shaw, Houston, TX (US)

(73) Assignee: SILVERWELL TECHNOLOGY LTD., Cambridgeshire (GB)

( * ) Notice: Subject to any disclaimer, the term of this patent is extended or adjusted under 35 U.S.C. 154(b) by 0 days.

(21) Appl. No.: 17/162,743

(22) Filed: Jan. 29, 2021

(65) Prior Publication Data

US 2021/0238967 A1 Aug. 5, 2021

Related U.S. Application Data

(60) Provisional application No. 62/968,709, filed on Jan. 31, 2020.

(51) Int. Cl.
*E21B 43/12* (2006.01)

(52) U.S. Cl.
CPC ..... *E21B 43/122* (2013.01)

(58) Field of Classification Search
CPC ..... E21B 43/122; E21B 43/121; E21B 43/13; B08B 9/0555; B08B 9/055; F16L 55/42; F04B 47/12
See application file for complete search history.

(56) References Cited

U.S. PATENT DOCUMENTS 4,502,843 A 3/1985 Martin
5,253,713 A 10/1993 Gregg et al.
6,147,034 A 11/2000 Jones et al.
6,148,923 A 11/2000 Casey
6,176,309 B1 1/2001 Bender
7,870,899 B2 1/2011 Wilson
7,954,545 B2 6/2011 Hearn et al.
(Continued)

FOREIGN PATENT DOCUMENTS

CN 105781494 A * 7/2016
CN 105781494 A 7/2016

OTHER PUBLICATIONS

Google English translation of CN105781494, with publication date of Jul. 20, 2016, 6 pages.
(Continued)

*Primary Examiner* — George S Gray
(74) *Attorney, Agent, or Firm* — Bracewell LLP; Constance G. Rhebergen; Keith R. Derrington

(57) ABSTRACT

A method and system of producing fluid from a well with a gas lift system that includes a virtual plunger made from a plunger forming material. The virtual plunger is formed downhole by injecting the plunger forming material directly into a column of liquid inside production tubing and from an annulus that circumscribes the production tubing. The flow of plunger forming material into the production tubing is controlled by an injection valve intersecting a sidewall of the production tubing. The plunger forming material is added to the annulus from the surface, and enough is added so its upper level is above the injection valve. Adding injection gas to the production tubing below the virtual plunger pushes the virtual plunger and column of liquid to surface. The plunger forming material has properties so that the virtual plunger remains cohesive while traveling uphole.

18 Claims, 8 Drawing Sheets

(56) References Cited

U.S. PATENT DOCUMENTS

| | | | | |
|---|---|---|---|---|
| 8,925,638 | B2 | 1/2015 | Wygnanski | |
| 9,297,247 | B2 | 3/2016 | Lea, Jr. | |
| 9,695,680 | B2 | 7/2017 | Bergman | |
| 2006/0225888 | A1 | 10/2006 | Reitz | |
| 2009/0321077 | A1* | 12/2009 | Norman | B08B 9/055 166/311 |
| 2011/0120499 | A1* | 5/2011 | Pruett | B08B 9/0553 134/22.12 |
| 2013/0312977 | A1* | 11/2013 | Lembcke | E21B 43/121 166/311 |

OTHER PUBLICATIONS

PCT ISRWO dated Apr. 30, 2021, in the prosecution of application PCT/GB2021/050220, 18 pages.

* cited by examiner

SYSTEM AND METHOD OF WELL OPERATIONS USING A VIRTUAL PLUNGER

CROSS-REFERENCE TO RELATED APPLICATION

This application is a continuation in part of and claims priority to and the benefit of U.S. Provisional Application Ser. No. 62/968,709, filed Jan. 31, 2020, the full disclosure of which is incorporated by reference herein in its entirety and for all purposes.

BACKGROUND OF THE INVENTION

1. Field of Invention

The present disclosure relates to a system and method of well operations using a virtual plunger formed downhole and that is made up of a flowable material that is cohesive during lifting or well unloading operations.

2. Description of Prior Art

Producing fluids, such as water, liquid hydrocarbons, and gas hydrocarbons, from within subterranean formations typically involves drilling a well into the formation and completing the well to provide passages for the fluid to make its way to the surface. Casing generally lines the wellbore, and perforations through the casing provide a pathway for the fluid to enter into the casing. Production tubing is usually installed inside the casing, and in which the fluids travel uphole and out of the well. Pressure in some formations is sufficient to drive liquids that accumulate in the well to surface. In those wells where formation pressure is insufficient pressure to lift the liquids to surface, assistance is available for lifting the liquids out of the well.

This lift assistance is often referred to as artificial lift; some common types of artificial are electrical submersible pumps, sucker rod pumping, gas lift, progressive cavity pumps, and plunger lift. In some instances, formation pressure is adequate early in the life of the well to lift the liquid to surface. But diminishes over time due to depleting liquids from within the formation, and requires artificial lift at later stages of the life of the well. In some instances artificial lift is a regular occurrence for producing fluid from a well, and in others artificial lift is used to periodically unload liquid that has accumulated in the well.

Plunger lift systems typically employ a plunger that is supported at a particular depth inside the production tubing. Liquids being produced from the well flow into the production tubing and upward around or through the plunger. A column of the liquid accumulates above the plunger inside the production tubing. Periodically gas from surface is injected into the production tubing and below the plunger, which forces the plunger and the column of liquid to a wellhead assembly on surface. From inside the wellhead assembly the liquid flows into a production line, which directs the liquid away from the wellsite for collection and/or processing. After the liquid lifted by the plunger enters the production line, the gas injection is suspended and the plunger falls back downhole to the particular depth. In these systems the plunger typically remains at the particular depth until the step of injecting gas into the production tubing is repeated.

SUMMARY OF THE INVENTION

Disclosed herein is a method of lifting liquid from inside a well that includes, adding a plunger forming material into an annulus that circumscribes a string of production tubing disposed in the well, injecting an amount of the plunger forming material from the annulus into an amount of liquid collected inside the string of production tubing to form a virtual plunger inside the string of production tubing, and to define a column of liquid above the virtual plunger that is made up of a portion of the amount of liquid that is above where the plunger forming material is injected into the string of production tubing, and injecting a gas into the string of production tubing to urge the virtual plunger and column of liquid upward inside the string of production tubing. The gas is optionally injected at a lesser depth, greater depth, or the same depth in the well than where the plunger forming material is injected. The method optionally further includes directing the virtual plunger and the column of liquid through a production line and to a location distal from the well. The method alternatively includes removing the virtual plunger from within the production tubing. The virtual plunger is optionally dissolved inside the production tubing. Pressure in the well is optionally monitored in the well, and plunger forming material is added into the annulus based on monitoring pressure in the well. In an example, the virtual plunger remains cohesive when being urged up the string of production tubing and defines a barrier between the gas injected into the string of production tubing and the column of liquid.

Another method of lifting liquid from inside of a well includes communicating lift gas from an annulus in the well to inside of a string of production tubing that is circumscribed by the annulus; where the string of production tubing contains a virtual plunger made from a cohesive plunger forming material and a column of the liquid above the virtual plunger. This example method also includes initiating a flow of the lift gas into the string of production tubing to a depth below the virtual plunger, and urging the virtual plunger and the column of the liquid upwards inside the string of production tubing by continuing the flow of the lift gas into the string of production tubing. In an alternative, the method further involves forming the virtual plunger by introducing an amount of the plunger forming material into the annulus, collecting the amount of the plunger forming material on a barrier disposed in the annulus, and injecting a portion of the amount of the plunger forming material from the annulus to inside of the string of production tubing. In an embodiment, the portion injected into the string of production tubing the column of liquid is at least at a designated length. In one example, the flow of the lift gas and the plunger forming material each enter the string of production tubing through separate valves that are each remotely actuated. The flow of the lift gas can enter the string of production tubing through a lift gas valve, and the plunger forming material can be introduced into the string of production tubing through a plunger forming material valve; in this example the lift gas valve is submerged in the plunger forming material in the annulus, and a tube provides communication between an inlet of the lift gas valve and a portion of the annulus above the plunger forming material.

A system for lifting liquid from inside of a well is also disclosed herein, and which includes a string of production tubing installed in the well, a virtual plunger that is disposed inside the string of production tubing, and that has an amount of cohesive plunger forming material injected into the string of production tubing, a column of the liquid above the virtual plunger, and an amount of lift gas injected into the string of production tubing and that is below the virtual plunger. The system also can include a lift gas supply system that is made up of a lift gas source, a lift gas line having an end connected to the lift gas source and an opposite end disposed in an annulus in the well, and lift gas in the lift gas source that selectively communicates with the annulus through the lift gas line, a plunger forming material supply system having, a plunger forming material source, a plunger forming material line having an end connected to the plunger forming material source and an opposite end disposed in an annulus in the well, and plunger forming material in the plunger forming material source that selectively communicates with the annulus through the plunger forming material line. In another embodiment the system includes a lift gas injection assembly having an inlet in communication with an annulus circumscribing the string of production tubing, and an outlet in selective communication with the string of production tubing, and a plunger forming material injection assembly having an inlet in communication with the annulus and an outlet in selective communication with the string of production tubing. The outlet of the lift gas injection assembly optionally couples with a lift gas injection port on the string of production tubing, and the lift gas injection port is submerged in an amount of the plunger forming material collected in the annulus. In an alternative, the outlet of the lift gas injection assembly couples with a lift gas injection port on the string of production tubing, the outlet of the plunger forming material injection assembly couples with a plunger forming material injection port on the string of production tubing, and the lift gas injection port is disposed at the same depth as the plunger forming material injection port, a lesser depth as the plunger forming material injection port, or at a greater depth as the plunger forming material injection port. In one example, the lift gas injection assembly has a lift gas injection valve, and a lift gas injection valve actuator coupled with the lift gas injection valve. In an example, the plunger forming material injection assembly includes a plunger forming material injection actuator coupled with the plunger forming material injection valve, and wherein the actuators are in communication with a controller disposed outside of the well on surface.

BRIEF DESCRIPTION OF DRAWINGS

Some of the features and benefits of the present invention having been stated, others will become apparent as the description proceeds when taken in conjunction with the accompanying drawings, in which.

Figure 1:
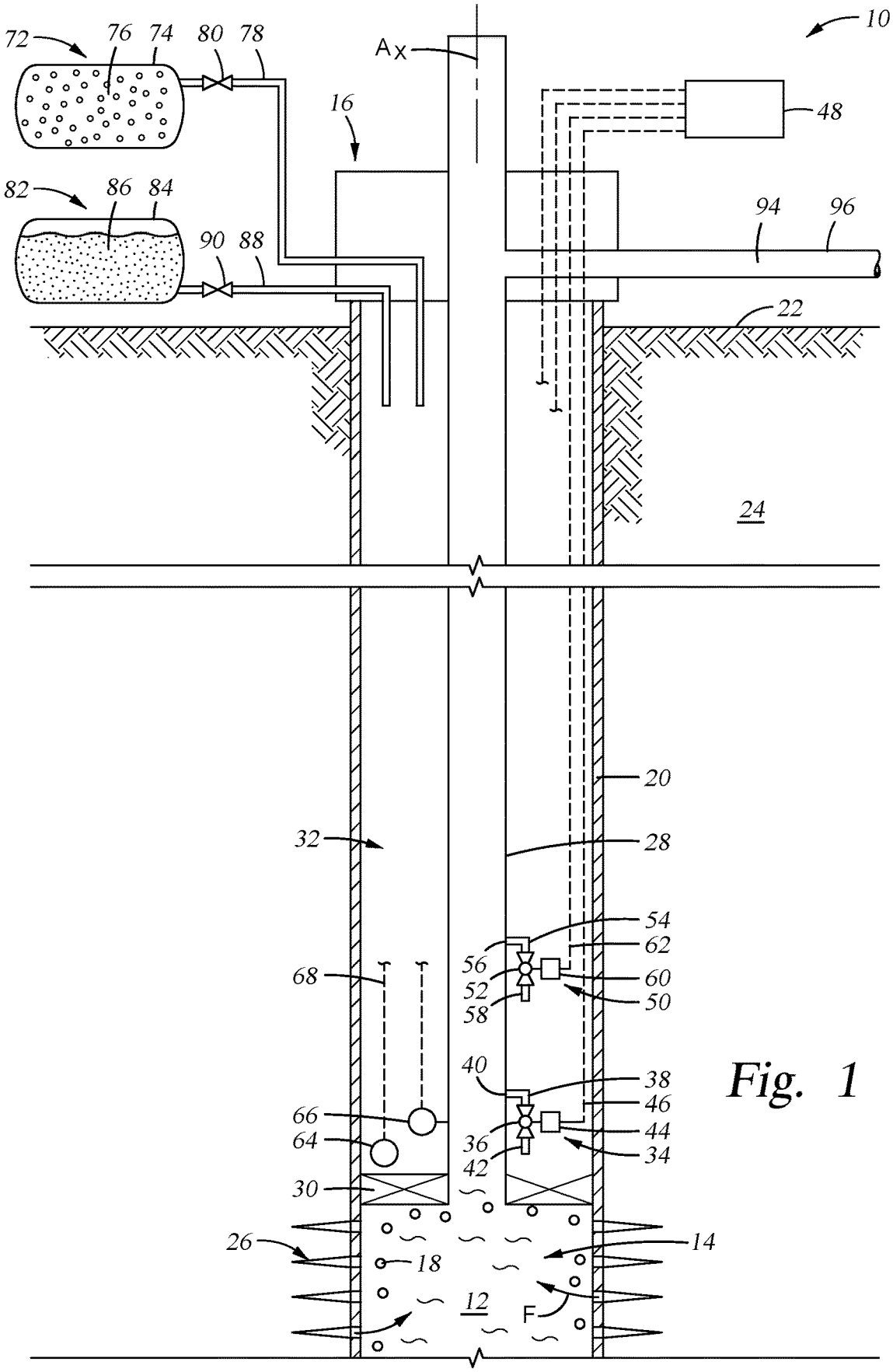
FIG. 1 is a side partial sectional view of an example of a gas lift system for use in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a partial side sectional view in FIG. 1 is an example of a gas lift system 10 used for lifting liquid 12 from within a wellbore 14. In the example shown a wellhead assembly 16 is mounted over an opening of the wellbore 14, and an amount of gas 18 is depicted mixed with the liquid 12. Casing 20 lines the wellbore 14, and is shown extending up the opening of wellbore 14 with its upper end terminating at surface 22. In the example shown cement (not shown) is between casing 20 and a formation 24 intersected by the wellbore 14. The cement isolates different zones at different depths in the formation 24 from one another. Perforations 26 are shown projecting radially outward from wellbore 14 through casing 20 and into formation 24. Fluid F flows from formation 24 into wellbore 14 via perforations 26. In the example shown the fluid F includes liquid 12 and gas 18 constituents, alternatives exist where fluid F is made up primarily of liquid 12. Examples of the liquid 12 include water, hydrocarbons, and mixtures thereof. For the purposes of discussion herein, the term "above" when used in conjunction to describe an item or items inside the well 14 or formation 24, means a location or a direction relative to the item or items that is towards surface 22. Also for the purposes of discussion herein, the term "below" when used in conjunction to describe an item or items inside the well 14 or formation 24, means a location or a direction relative to the item or items that is away from surface 22.

In the embodiment of FIG. 1 a string of production tubing 28 is shown installed within wellbore 14 and that selectively transports fluid F to wellhead assembly 16 on surface 22. A packer 30 is shown circumscribing a portion of the production tubing 28, in this example packer 30 is in sealing contact with production tubing 28 and casing 20. Packer 30 defines a barrier to vertical flow within an annulus 32 defined between the production tubing 28 and inner sidewalls of wellbore 14. In the example shown, packer 30 blocks the flow of fluid F into annulus 32, which redirects fluid F to inside of the production tubing 28.

The gas lift system 10 of FIG. 1 also includes a plunger forming material injection assembly ("injection assembly") 34 depicted in the annulus 32 and coupled with an outer surface of the production tubing 28. In the illustrated example the injection assembly 34 includes a plunger forming material valve ("valve") 36; examples exist where valve 36 is a ball valve, gate valve, globe valve, and any other type of device that selectively allows a flow of fluid there-through. Annular outlet tubing 38 is shown connected between an end of the valve 36 and a plunger forming material injection port ("injection port") 40, which is depicted as an opening through a sidewall of the production tubing 28. The example of FIG. 1 also includes annular inlet tubing 42, which connects to the valve 36 on an end opposite from outlet tubing 38; valve 36 is in communication with annulus 32 via the inlet tubing 42. In an alternative, inlet tubing 42 is not included and instead that end of the valve 36 communicates directly with annulus 32. Further in this example valve 36 couples to a plunger forming material injection valve actuator ("valve actuator") 44 that is an actuating means to selectively open and close valve 36. Example motive means of the valve actuator 44 include electrical, mechanical, pneumatic, and combinations. A control line 46 is shown with an end coupled to valve actuator 44, and with an opposite end coupled with a controller 48 schematically depicted outside of the wellbore 14. In a non-limiting example, valve actuator 44 and controller 48 are in communication via control line 46.

Included in the example of FIG. 1 is a lift gas injection assembly 50 depicted disposed in the annulus 32 and including a lift gas injection valve 52. Outlet tubing 54 is shown coupled between an outer surface of production tubing 28 and an end of the lift gas injection valve 52. An end of outlet tubing 54 distal from lift gas injection valve 52 registers with a lift gas injection port 56 formed through a sidewall of the production tubing 28. An annular length of inlet tubing 58 is shown provided on an end of lift gas injection valve 52 opposite from outlet tubing 54 and which is in communication with annulus 32. In one alternative, the inlet tubing 58 is not included and an end of the lift gas injection valve 52 is in direct communication with the annulus 32. A lift gas injection valve actuator 60 is shown coupled with the lift gas injection valve 52, and in signal communication with controller 48 via signal line 62. In a non-limiting example of operation, command signals from controller 48 and via control lines 46, 62 selectively actuate valves 36, 52 by initiating operation of actuators 44, 60. In an alternative command signals are generated algorithmically within controller 48, by a separate processor (not shown), or transmitted by operations personnel on surface 22. Optional sensors 64, 66 are shown disposed within annulus 32. In an example, sensor 64 senses pressure in the annulus 32, and sensor 66 senses pressure within production tubing 28 via a pressure tap shown inserted into production tubing 28. Optionally, sensors 64, 66 communicate with controller 48 via control lines 68, 70 shown extending upward within annulus 32 and through wellhead assembly 16. Further optionally, command signals transmitted downhole to actuators 44, 60 are responsive at least in part to information sensed by sensors 64, 66 and communicated to controller 48.

An example of a lift gas supply system 72 is shown included with the gas lift system 10, and which includes a lift gas source 74 that is depicted on surface 22. Embodiments of the lift gas source 74 include a pressurized vessel, a compressor that receives a supply of lift gas and compresses lift gas, and a piping circuit, such as one having feed of lift gas from surrounding wells. Lift gas 76 is schematically depicted within the lift gas source 74, and which is in selective communication with annulus 32 via a lift gas line 78. As shown, lift gas line 78 connects on one end to the lift gas source 74 and has another end depending within annulus 32. A lift gas supply valve 80 is included in this example and shown on the lift gas line 78. In a non-limiting example, selective actuation of lift gas supply valve 80 controls communication between the lift gas source 74 and annulus 32. In the example of FIG. 1, the lift gas supply valve 80 is shown in a closed position, and which blocks communication of lift gas 76 from the source 74 to annulus 32.

An example of a plunger forming material supply system ("supply system") 82 is included with the embodiment of FIG. 1, and shown including a plunger forming material source ("material source") 84 which is disposed outside of the wellbore 14. A plunger forming material 86 is schematically depicted within the source 84. In an example, plunger forming material 86 is a flowable substance, and which when injected into production tubing 28 remains substantially cohesive. In an alternative, plunger forming material 86 transforms fluid within the production tubing 28 into a cohesive mass. Shown extending between the source 84 and the inside of annulus 32 is a plunger forming material supply line ("supply line") 88. In the example shown, supply line 88 provides a conduit for the plunger forming material 86 to flow from source 84 and into annulus 32. A plunger forming material supply valve ("material supply valve") 90 is illustrated disposed in the supply line 88, and which when actuated controls passage of the plunger forming material 86 there-through and to annulus 32. In the embodiment shown material supply valve 90 is in a closed position.

Figure 2:
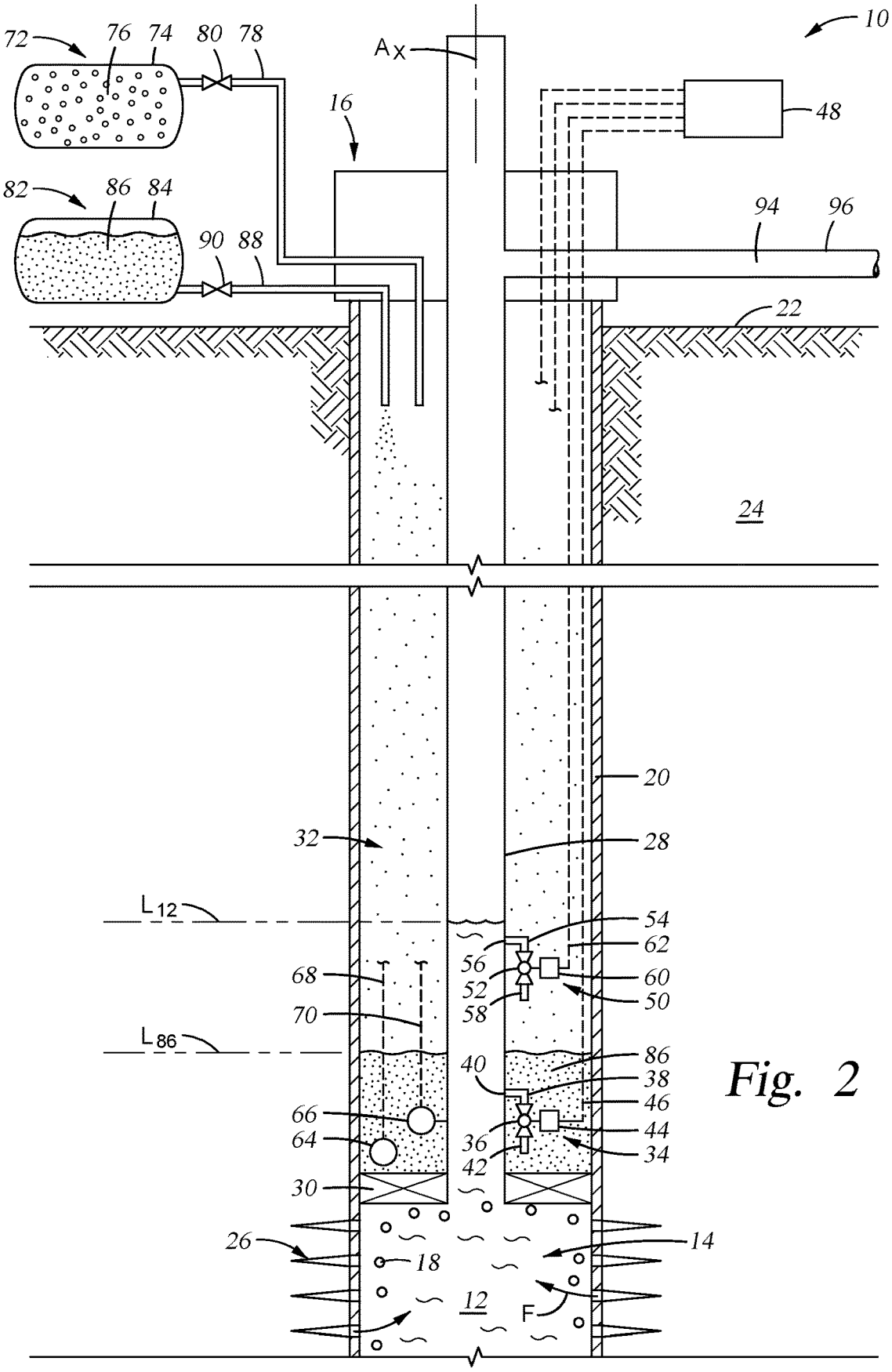
FIGS. 2 and 3 are side partial sectional views of an example of forming a virtual plunger downhole using the gas lift system of FIG. 1.

Schematically illustrated in FIGS. 2-7 is a non-limiting example of operating the wellbore 12 with the gas lift system 10 and supply system 82. As shown in side partial sectional view in FIG. 2. the material supply valve 90 is configured into an open position, so that plunger forming material 86 entering the supply line 88 from the source 84 flows through line 88, past valve 90, and exits line 88 within annulus 32. After exiting line 88, the plunger forming material 86 lands and collects on the packer 30. As noted above, the packer 30 is in sealing contact with the production tubing 28 and casing 20 and defines a flow barrier in the annulus 32. In the example shown, the plunger forming material 86 deposited into annulus 32 accumulates on the packer 30 up to a level $L_{86}$ within annulus 32. Level $L_{86}$ of FIG. 2 is depicted at a depth that is above the inlet tubing 42 of the injection assembly 34. For purposes of reference, an upper level of the liquid 12 within the production tubing 28 is represented by $L_{12}$.

Figure 3:
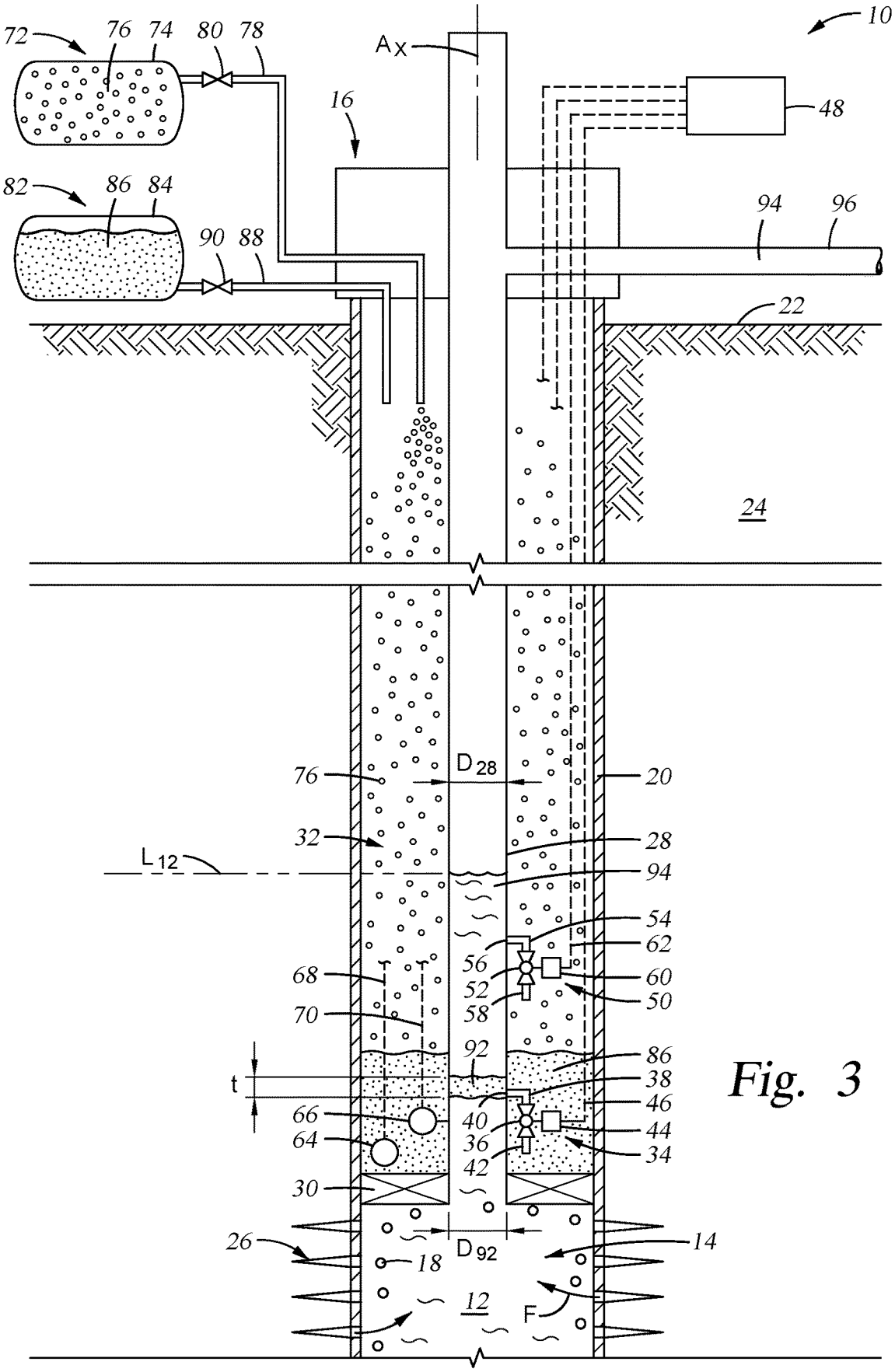

Referring now to FIG. 3, illustrated in a partial side sectional view is a non-limiting example step of forming a virtual plunger 92. The virtual plunger 92 is depicted disposed within the production tubing 28 and adjacent the injection assembly 34. In an embodiment, material properties of the plunger forming material 86 are such that the virtual plunger 92 is cohesive and generally retains a coherent form within the production tubing 28. Examples exist of the virtual plunger 92 remaining coherent (i.e. sticking together as a substantially single body) when subjected to external forces when the virtual plunger 92 is moving and when it is at rest. The material properties of the plunger 92, in combination with it having a size that occupies all or substantially all of a radial cross section inside of the production tubing 28, defines a member across which forces are selectively transferred within the production tubing 28. In an alternative, virtual plunger 92 is formed by injecting the plunger forming material 86 from the annulus 32, into the production tubing 28, and through the injection assembly 34. An example of injecting plunger forming material 86 into production tubing 28 occurs by opening valve 36 when pressure in annulus 32 exceeds pressure in the production tubing 28; so that the pressure differential between the annulus 32 and production tubing 28 urges a portion of the plunger forming material 86 collected within annulus 32 into the production tubing 28 via the inlet tubing 42, valve 36, outlet tubing 38, and injection port 40. In one embodiment, the amount of the plunger forming material 86 injected into the production tubing 28 is sufficient to form a body that occupies substantially all of a cross sectional area inside of a portion of the production tubing 28. Examples of amount include a volume, a mass, or both, and the amount injected is dependent on the pressure differential between the annulus 32 and tubing 28, the time duration over which the plunger forming material 86 is being injected, and physical properties of the plunger forming material 86 and fluid F. In an alternative, a designated amount of plunger forming material 86 is injected into the production tubing 28, where the designated amount is defined by an amount of plunger forming material 86 that occupies substantially all of a cross sectional area inside of a portion of the production tubing 28, and also has a thickness t in a direction along axis $A_X$ of production tubing 28. The thickness t of the virtual plunger 92 is at a magnitude so that the virtual plunger 92 remains coherent when subjected to external forces (such as shear forces, compression forces, tension forces) during stages of its operation. In an example, the thickness t is variable, and has a minimum value so that the virtual plunger 92 remains coherent during operation. Examples of operation of the virtual plunger 92 include travel of the virtual plunger 92 within the tubing 28, use of the virtual plunger 92 in conjunction with the gas lift system 10, and any other activity involving the virtual plunger 92. It is within the capabilities of one skilled to operate the gas lift system 10 so that defined amounts, including designated amounts, of plunger forming material 86 are injected into the production tubing 28. In an embodiment, diameter $D_{92}$ of plunger 92 is substantially that of an inner diameter $D_{28}$ of production tubing 28; similarly, cross sectional areas of plunger 92 and inside of production tubing 28 in a plane perpendicular to axis $A_X$ are substantially the same. In an alternative, plunger forming material 86 includes a gelling agent that when in contact with the liquid L inside production tubing 28 increases a viscosity of an amount of liquid L inside production tubing 28 to form plunger 92. Example gelling agents include one or more of a phosphate ester and cross linking agent; an exemplary embodiment of a gelling agent is in Jones et al., U.S. Pat. No. 6,147,034, which is incorporated by referenced herein in its entirety and for all purposes.

In the example of FIG. 3, the plunger forming material 86 is injected into the production tubing 28 at a location below level $L_{12}$; which forms the virtual plunger 92 so that liquid 12 is on opposing sides of the virtual plunger 92. Depicted in FIG. 3 is that a column of liquid 12 is between the virtual plunger 92 and level $L_{12}$; the column of liquid 12 defines an amount of produced fluid 94. In an example the virtual plunger 92 is coherent, and distinguishable from liquid 12, in some embodiments virtual plunger 92 does not mix with or become dispersed within the liquid 12 on either of its opposing sides. In an alternative, the plunger forming material 86 is injected into the production tubing 28 at a point in time when the column of liquid is at a level Lu close to or substantially at a maximum level of accumulation that is expected during normal operation of the wellbore 14.

Figure 4:
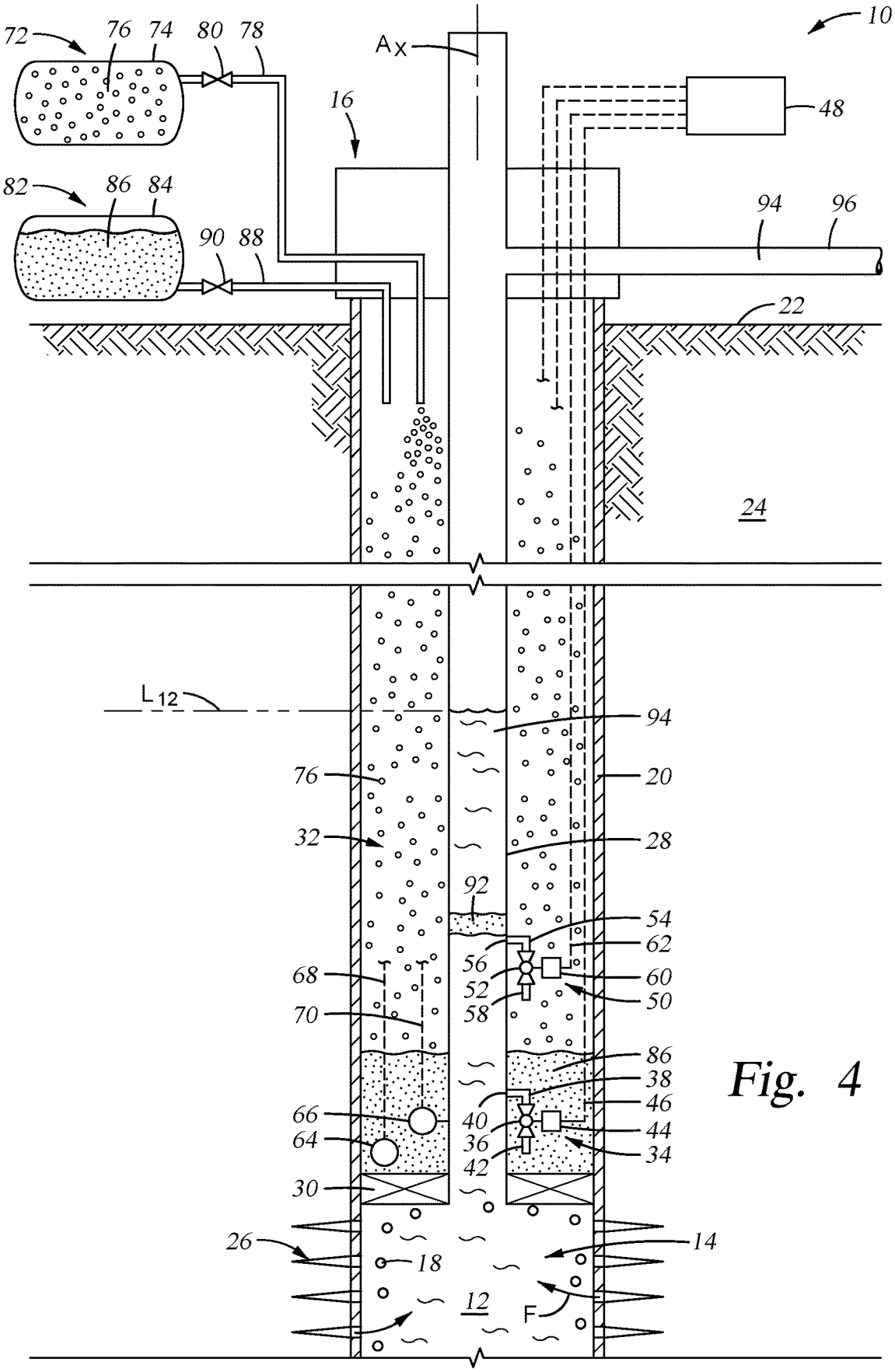
FIG. 4 is a side partial sectional view of an example of the virtual plunger of FIG. 3 below a column of production fluid.

Shown in a side partial sectional view in FIG. 4, is an example of a step of operation of the wellbore 14 subsequent to the virtual plunger 92 being formed. As shown, the virtual plunger 92 is urged along axis $A_X$ to a depth between the lift gas injection port 56 and wellhead assembly 16. In an example, the step of urging the virtual plunger 92 is from a buoyancy force due to the virtual plunger 92 having a density less than that of the liquid 12; alternatively, fluid F flowing from the formation into the production tubing 28 urges the virtual plunger 92 and amount of produced fluid 94 axially within production tubing 28. In the example shown, substantially all of the amount of produced fluid 94 remains above the virtual plunger 92 due at least in part to the coherent nature of the virtual plunger 92 that enables the virtual plunger 92 to remain largely intact and distinguishable from the liquid 12 when subjected to external forces.

Figure 5:
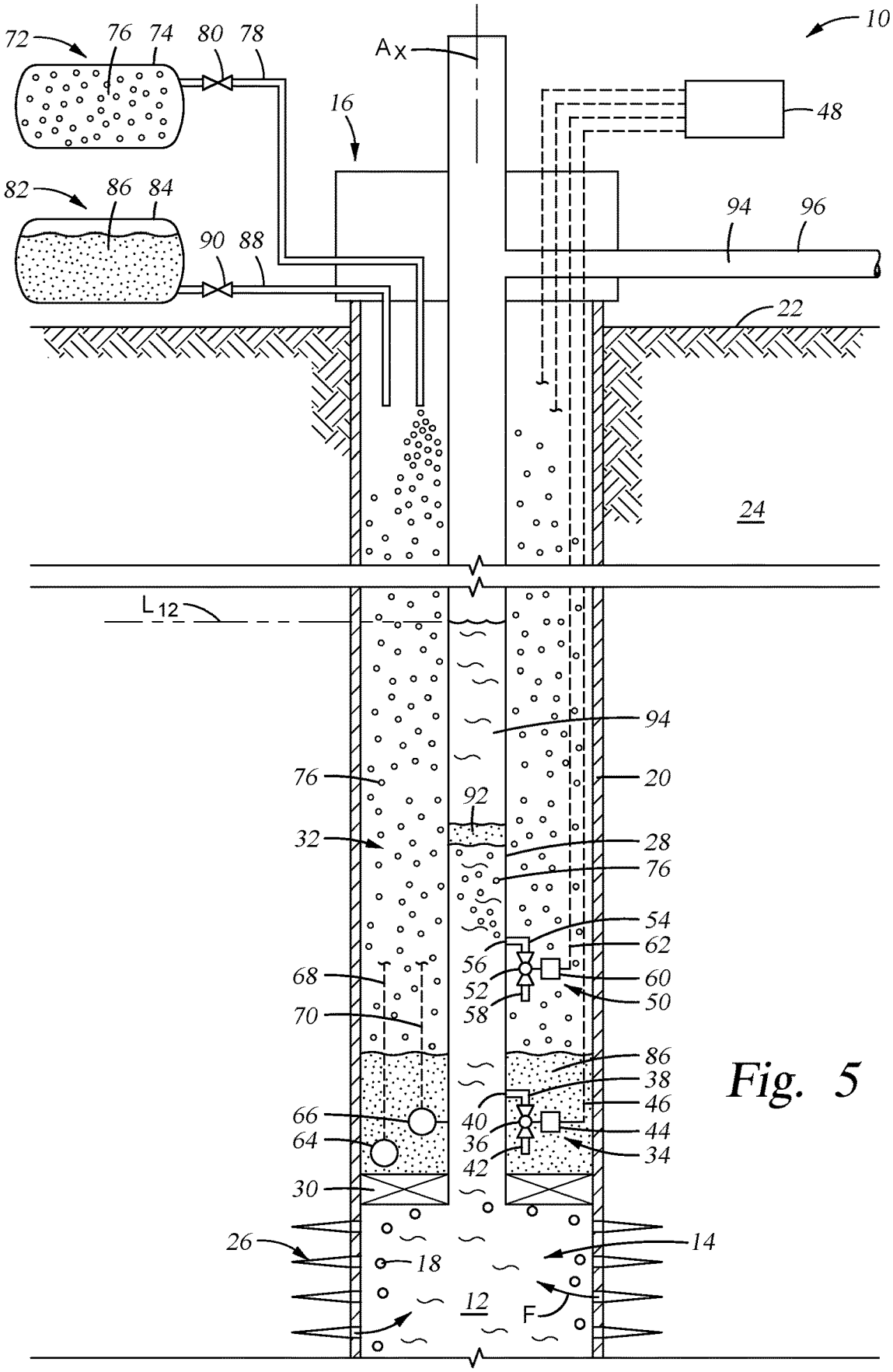
FIG. 5 is a side partial sectional view of an example of introducing lift gas below the virtual plunger and column of production fluid of FIG. 4.

Referring now to FIG. 5, an example step of operation of the gas lift system 10 is illustrated in side sectional view; and in which an amount of lift gas 76 is shown having been injected within the production tubing 28 between the virtual plunger 92 and packer 30. Referring back to FIG. 3, lift gas 76 is shown being introduced into the annulus 32 through an open lift gas supply valve 80. Opening the lift gas supply valve 80 allows lift gas 76 to flow through the lift gas supply line 78 into the annulus 32. In an alternate embodiment, the annulus 32 is filled with an amount of lift gas 76 prior to introduction of the plunger forming material 86 into annulus 32. Referring back to FIG. 5, in the example lift gas 76 is introduced into the production tubing 28 via the lift gas injection assembly 50. In one example, lift gas injection valve 52 is configured to an open position via a command from controller 48 to actuator 60. Opening lift gas injection valve 52 provides fluid communication between annulus 32 and inside of production tubing 28 through the inlet tubing 58, lift gas injection valve 52, outlet tubing 58 and lift gas injection port 56. In the embodiment of FIG. 5, lift gas 76 has a density less than both the virtual plunger 92 and produced fluid 94. The lower density lift gas 76 is urged towards surface 22 by buoyancy forces, which are transferred to the virtual plunger 92 and produced fluid 94 to also lift them to surface 22 within the production tubing 28. As noted above, the virtual plunger 92 remains coherent when exposed to the forces (i.e. shear, compressional, tension) exerted by the buoyant lift gas 76.

Figure 6:
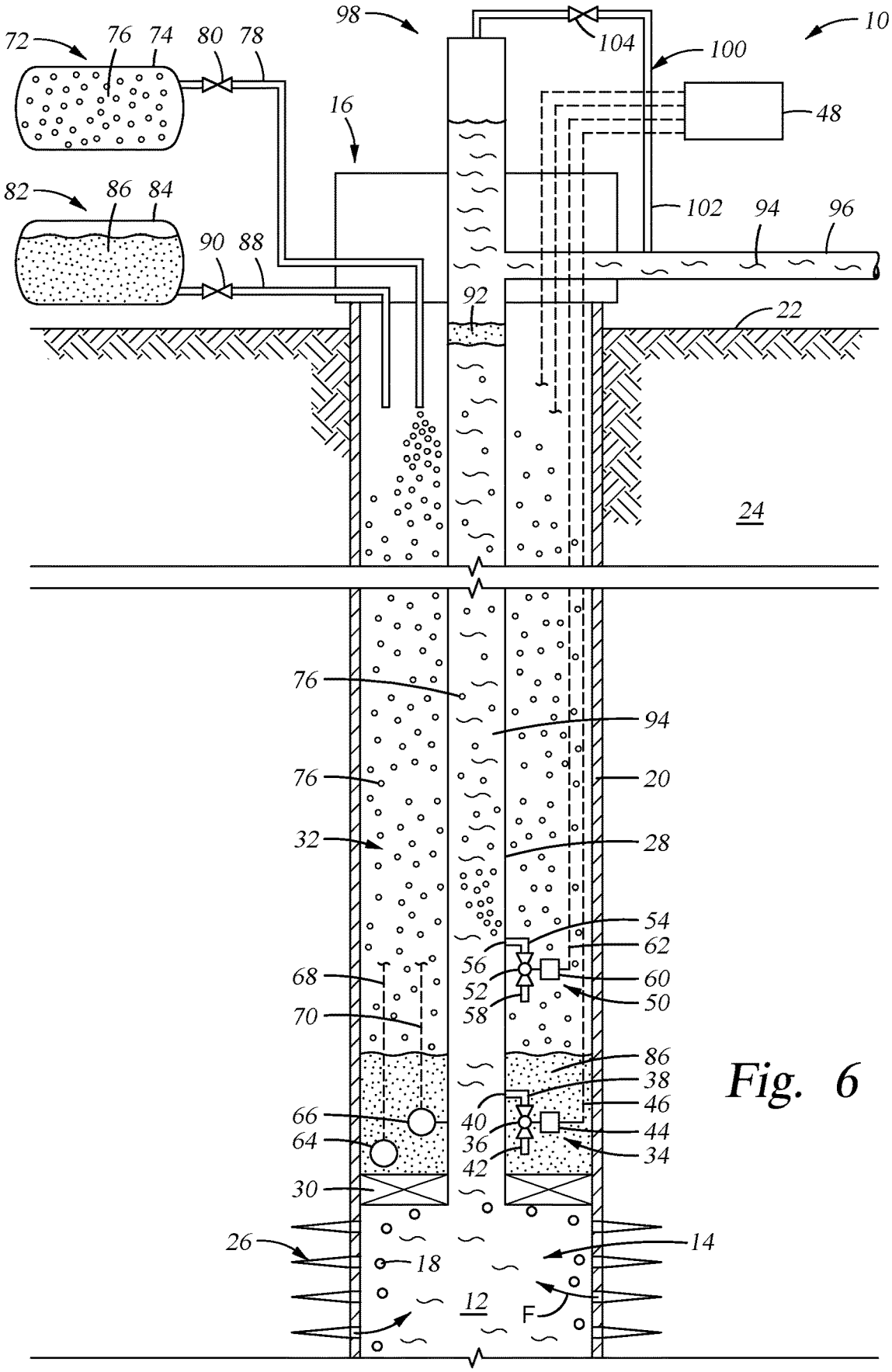
FIGS. 6 and 7 are side partial sectional views of an example of driving the virtual plunger and column of production fluid of FIG. 5 to surface with lift gas.

Depicted in side sectional view in FIG. 6 is an example step of operation in which lift gas injection valve 52 remains in an open configuration to allow a continued flow of the lift gas 76 into the production tubing 28. The continued flow of lift gas 76 into the production tubing 28 maintains the buoyant force onto the virtual plunger 92 and produced fluid 94 to urge the virtual plunger 92 and the produced fluid 94 through the production tubing 28 and into wellhead assembly 16. Inside the wellhead assembly 16, a portion of the produced fluid 94 enters a production line 96 shown connected to wellhead assembly 16, and which in an example provides a conduit for transporting the produced fluid away from the wellbore 14 into a location for processing and/or storage. An optional lubricator 98 is shown at a terminal portion of production tubing 28 and adjacent wellhead assembly 16. Lubricator 98 has an opening that registers with the production tubing 28 and is shown receiving a remaining portion of the produced fluid 94 that does not enter the production line 96. An optional bypass circuit 100 is shown connecting lubricator 98 with production line 96. Bypass circuit 100 includes a line 102 having the produced fluid 94 and a block valve 104, shown in an open position that selectively is opened and closed to block flow through the line 102.

Figure 7:
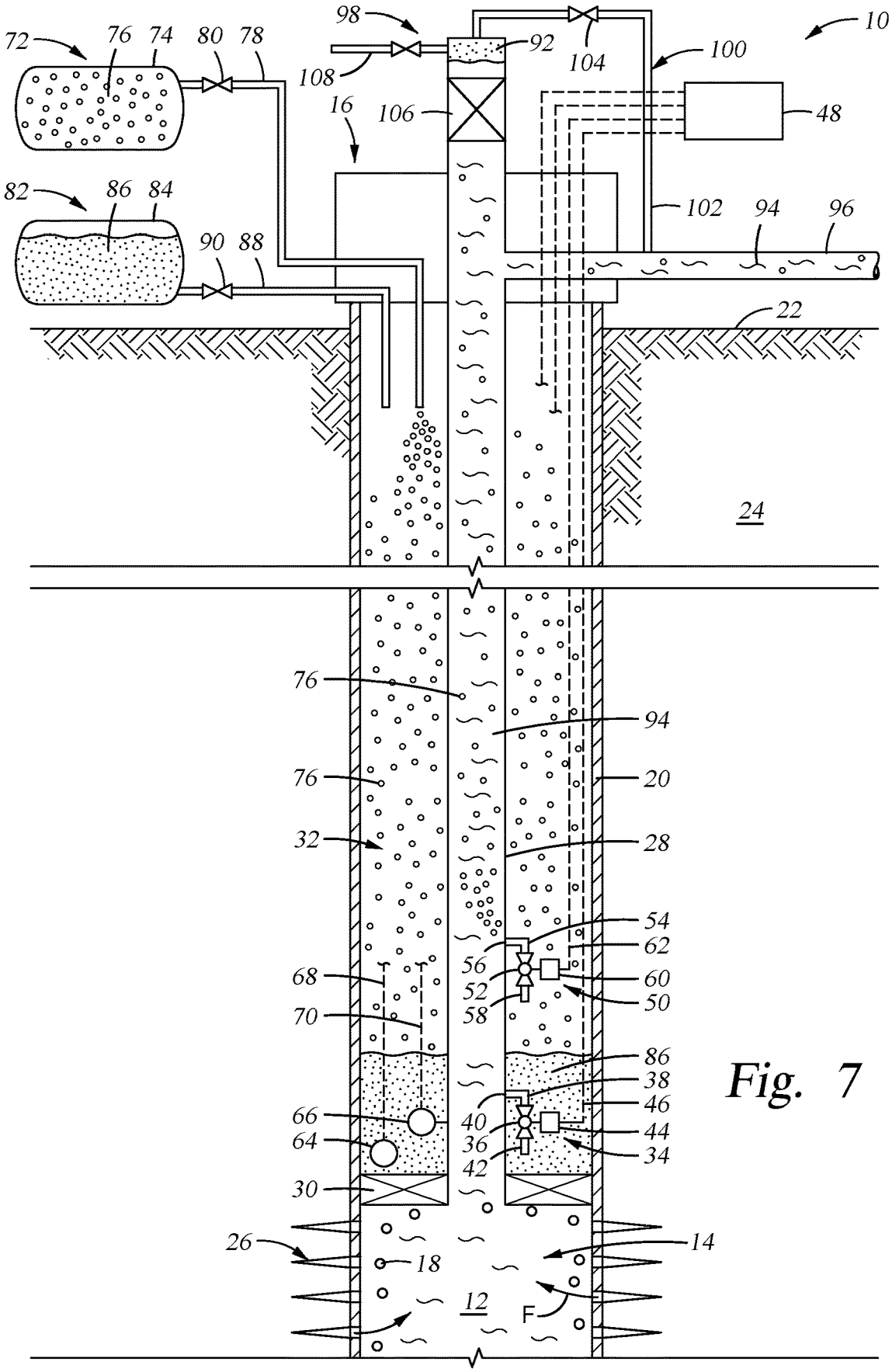

A further example step of operation of the gas lift system 10 is shown in a partial side sectional view in FIG. 7 in which lift gas 76 continues to be introduced into the production tubing 28 by maintaining the lift gas injection valve 52 in an open configuration. The buoyancy added by the lift gas 76 further urges the virtual plunger 92 to an upper end of lubricator 98. In one embodiment, virtual plunger 92 is urged past a swab valve 106, which is then optionally put into a closed position to retain the virtual plunger 92 in the lubricator above the swab valve 106. In the example shown, the virtual plunger 92 is retrieved from the lubricator 98 via a bleed line 108. In an alternative, a master valve is in place of swab valve 106, and a wing valve is installed in or put in place of the bleed line 108. Other embodiments exist where the virtual plunger 92 passes into the production line 96 and is recovered during processing of the production fluid 94. In other alternatives, treatment chemicals, such as fluid breakers, are introduced into the production tubing 28 to reduce the viscosity of the virtual plunger 92 and/or make it dissolvable within other fluids in the production tubing 28 or production line 96. In another alternative, a separator (not shown) is used for separating the virtual plunger 92 from the production fluid 94. In a further embodiment, one or more virtual plungers 92 are formed while another virtual plunger 92 is rising within the production tubing 28 so that multiple virtual plungers 92 are within the production tubing 28 concurrently. Alternatives to this embodiment include the multiple virtual plungers 92 being consolidated into a single larger plunger, and spaced apart from one another.

Figure 8:
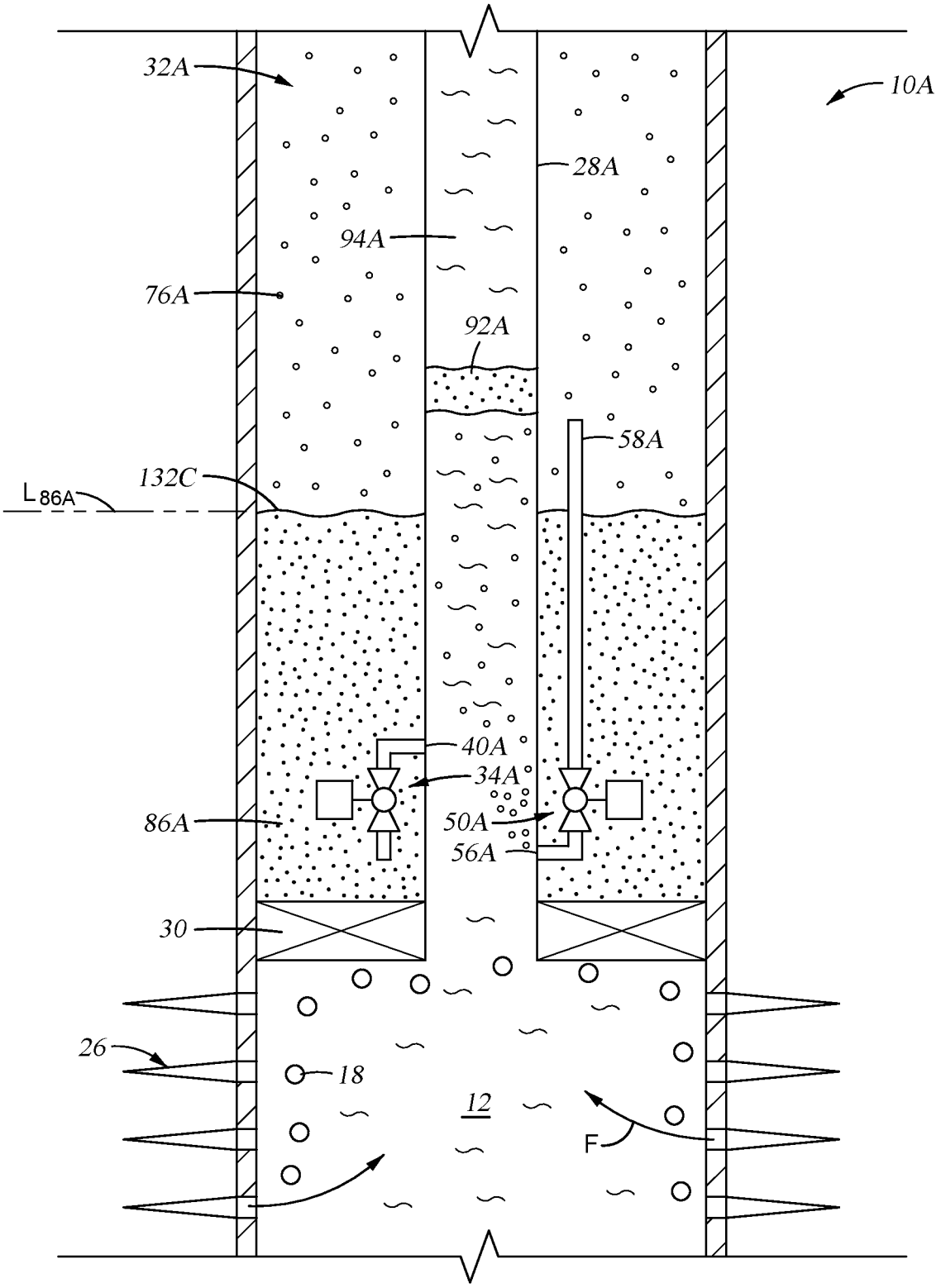
FIG. 8 is an alternate example of a portion of the gas lift system of FIG. 1.

An alternate embodiment of a portion of the gas lift system 10A is shown in a side sectional view in FIG. 8. In this example, lift gas injection assembly 50A is disposed at a depth below that of the injection assembly 34A and depicted submerged within plunger forming material 86A. So that the lift gas injection valve 52A is in communication with lift gas 76A within the annulus 32A, the inlet tubing 58A extends a distance upward within the annulus 32A and past the level $L_{86A}$ of the plunger forming material 86A. In this example, the ensuing virtual plunger 92A is formed at a depth within the production tubing 28A which is above the lift gas injection port 56A. Further in this example, lift gas 76A is optionally injected through the lift gas injection port 56A below where the plunger forming material 86A is injected into the production tubing 28A and without the need for upward movement of the virtual plunger 92A.

In alternatives, the gas lift system 10 is used in the normal production of a hydrocarbon producing well and where the sequence of forming the virtual plunger 92, 92A is repeated at points in time when the level of liquid 12 within production tubing 28 reaches a designated level Lu. Alternatively, the gas lift system 10 is used in situations that occasionally require the unloading of a liquid 12 from within the wellbore 14. An example of unloading include removing liquid 12 that has accumulated within the production tubing 28 and/or annulus 32 to a level that the level of the accumulated liquid 12 generates a hydrostatic pressure that exceeds pressure in the formation 24 and blocks a flow of fluid from the formation into the wellbore 14. In another example of unloading, liquid 12 has accumulated in the wellbore 14 during a period of time when the wellbore 14 was shut in, or the liquid 12 is from drilling, completion, or remediation. In wells that liquid is continuously produced, an advantage of a virtual plunger as described herein or that of a traditional plunger is that the downhole components associated with a traditional plunger are not required. Further, a plunger is not left in the production tubing in the time period when the liquid is flowing into the production tubing. Examples of the lift gas injection assembly 50 and the injection assembly 34 include that described in Wygnanski, U.S. Pat. No. 8,925,638, and which is incorporated by reference herein its entirety and for all purposes. Further alternatives to the lift gas injection assembly 50 and injection assembly 34 are valves that open automatically in response to pressure in the annulus 32, pressure inside the production tubing 28, or a pressure difference between the production tubing 28 and annulus 32. A further advantage of the virtual plug of the present disclosure is that the operational step of returning a plunger back downhole is eliminated, which is required in traditional plunger systems. Without the plunger return step a greater percentage of total operational time and energy is devoted to actually lifting fluids from within the well, and which increases an overall production rate. Also, without a plunger resident inside the production tubing 28 that restricts fluid F flowing into the production tubing 28, the rate at which production fluid 94 is formed is also increased.

Examples exist where properties and/or characteristics of the virtual plunger 92 is dependent on a particular well, a specific operation, or a specific operation within a particular well. Various embodiments of a virtual plunger 92 are included which have different material, chemistry, or constituents. In a non-limiting example, design criteria considered for forming a virtual plunger 92 include setting its density to be similar to the density of the produced fluids in the well so that a rate of ascent within the production tubing 28 is at or approximate to designated rate, or within a designated range. It is within the capabilities of those skilled to identify a designated rate and/or range. Another example design criteria is a shear strength of the resulting virtual plunger 92, 92A that is sufficient to withstand forces encountered during ascent (e.g. shear forces from the sidewalls of the production tubing 28, and buoyancy forces of the lift gas 76) and remain cohesive enough to lift the production fluid 94 above the virtual plunger 92, 92A. In a further example, a maximum shear strength of the material making up the virtual plunger 92, 92A is designated so that the material not plunger valve 36. Embodiments exist that the plunger forming material 86 is hydrophobic and coalesces in the presence of water or the produced fluid 94 rather than becoming mixed therein. Optionally, material selection includes consideration to resist the degrading effects of corrosive fluids so that the plunger 92 remains substantially cohesive throughout its travel within the production tubing 92.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. In an example, plunger forming material 86 includes a substance used for treating the production tubing 28, such as a lubricant, rust inhibitor, combinations, and the like. These and other similar modifications will readily suggest themselves to those skilled in the art, and are intended to be encompassed within the spirit of the present invention disclosed herein and the scope of the appended claims.

What is claimed is:

1. A method of lifting liquid from inside a well comprising:

introducing a plunger forming material into an annulus that circumscribes a string of production tubing disposed in the well; and injecting an amount of the plunger forming material from the annulus into an amount of liquid collected inside the string of production tubing to form a plunger inside the string of production tubing that is cohesive and resistant to shear forces, and to define a column of liquid above the plunger that is made up of a portion of the amount of liquid that is above where the plunger forming material is injected into the string of production tubing for lifting the liquid.

2. The method of claim 1, further comprising injecting a gas into the string of production tubing to urge the plunger and column of liquid upward inside the string of production tubing.

3. The method of claim 2, wherein the gas is injected at a greater depth in the well than where the plunger forming material is injected.

4. The method of claim 3, wherein the gas is injected into the string of production tubing through a valve that is in communication with lift gas that is above the plunger forming material.

5. The method of claim 2, further comprising using the gas to direct the plunger and the column of liquid from the production tubing and through a production line and to a location distal from the well.

6. The method of claim 1, wherein the plunger forming material is selected from the group consisting of a material having a viscosity greater than the liquid, and a gelling agent that transforms a portion of the liquid into the plunger.

7. The method of claim 1, further comprising dissolving the plunger inside the production tubing.

8. The method of claim 1, further comprising monitoring pressure in the well, and adding the plunger forming material into the annulus based on monitoring pressure in the well.

9. The method of claim 2, wherein the plunger remains coherent when being urged up the string of production tubing and defines a barrier between the gas injected into the string of production tubing and the column of liquid.

10. A method of lifting liquid from inside of a well comprising:

communicating lift gas from an annulus in the well to inside of a string of production tubing that is circumscribed by the annulus, the string of production tubing containing a plunger made from a cohesive plunger forming material, and a column of the liquid that is above the plunger;

flowing the lift gas into the string of production tubing to a depth below the plunger;

urging the plunger and the column of the liquid upwards inside the string of production tubing by continuing the flow of the lift gas into the string of production tubing; and forming the plunger by, introducing an amount of the plunger forming material into the annulus, collecting the amount of the plunger forming material on a barrier disposed in the annulus, and injecting a portion of the amount of the plunger forming material from the annulus to inside of the string of production tubing.

11. The method of claim 10, wherein when the portion is injected into the string of production tubing, the column of liquid is at least at a designated length.

12. The method of claim 10, wherein the flow of the lift gas and the plunger forming material each enter the string of production tubing through separate valves that are each remotely actuated.

13. The method of claim 10, wherein the flow of the lift gas enters the string of production tubing through a lift gas valve, and the plunger forming material is introduced into the string of production tubing through a plunger forming material valve, wherein the lift gas valve is submerged in the plunger forming material in the annulus, and wherein a tube provides communication between an inlet of the lift gas valve and a portion of the annulus above the plunger forming material.

14. A system for lifting liquid from inside of a well comprising:

a string of production tubing installed in the well;

a plunger forming material injection assembly having an inlet in communication with an annulus circumscribing the string of production tubing and an outlet in selective communication with the string of production tubing;

a plunger that is disposed inside the string of production tubing, and that comprises an amount of cohesive plunger forming material injected into the string of production tubing from the plunger forming material injection assembly;

a column of the liquid above the plunger;

a lift gas injection assembly having an inlet in communication with an annulus circumscribing the string of production tubing, and an outlet in selective communication with the string of production tubing; and an amount of lift gas injected from the lift gas injection assembly into the string of production tubing and that is below the plunger.

15. The system of claim 14, wherein the lift gas injection assembly further comprises:

a lift gas supply system that comprises, a lift gas source, a lift gas line having an end connected to the lift gas source and an opposite end disposed in an annulus in the well, and lift gas in the lift gas source that selectively communicates with the annulus through the lift gas line; and wherein the plunger forming material injection assembly comprises a plunger forming material supply system that comprises, a plunger forming material source, a plunger forming material line having an end connected to the plunger forming material source and an opposite end disposed in an annulus in the well, and plunger forming material in the plunger forming material source that selectively communicates with the annulus through the plunger forming material line.

16. The system of claim 14, wherein the outlet of the lift gas injection assembly couples with a lift gas injection port on the string of production tubing, and wherein the lift gas injection port is submerged in an amount of the plunger forming material collected in the annulus.

17. The system of claim 14, wherein the outlet of the lift gas injection assembly couples with a lift gas injection port on the string of production tubing, wherein the outlet of the plunger forming material injection assembly couples with a plunger forming material injection port on the string of production tubing, and wherein the lift gas injection port is disposed at a location selected from the group consisting of the same depth as the plunger forming material injection port, a lesser depth as the plunger forming material injection port, and a greater depth as the plunger forming material injection port.

18. The system of claim 14, wherein the lift gas injection assembly comprises a lift gas injection valve, and a lift gas injection valve actuator coupled with the lift gas injection valve, wherein the plunger forming material injection assembly comprises a plunger forming material injection actuator coupled with the plunger forming material injection valve, and wherein the actuators are in communication with a controller disposed outside of the well on surface.

* * * * *